US011058201B2

(12) United States Patent
Yoo et al.

(10) Patent No.: US 11,058,201 B2
(45) Date of Patent: Jul. 13, 2021

(54) DRYER

(71) Applicant: LG ELECTRONICS INC., Seoul (KR)

(72) Inventors: Hyunsun Yoo, Seoul (KR); Jaehung Chun, Seoul (KR); Yousook Eun, Seoul (KR); Joogyeom Kim, Seoul (KR); Sungkyung Kim, Seoul (KR); Myongsun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/576,417

(22) Filed: Sep. 19, 2019

(65) Prior Publication Data

US 2020/0085162 A1 Mar. 19, 2020

Related U.S. Application Data

(60) Provisional application No. 62/733,478, filed on Sep. 19, 2018.

(30) Foreign Application Priority Data

Dec. 14, 2018 (KR) ..... 10-2018-0162188
Feb. 25, 2019 (KR) ..... 10-2019-0022026
Jul. 22, 2019 (KR) ..... 10-2019-0088428

(51) Int. Cl.
*A45D 20/12* (2006.01)

(52) U.S. Cl.
CPC ..... *A45D 20/12* (2013.01)

(58) Field of Classification Search
CPC ..... A45D 20/00; A45D 20/12; A45D 20/20
(Continued)

(56) References Cited

U.S. PATENT DOCUMENTS 5,568,691 A * 10/1996 Rubin ..... A45D 20/16 34/98
5,884,008 A * 3/1999 Goldberg ..... A45D 20/12 206/320

(Continued)

FOREIGN PATENT DOCUMENTS

CA 2273828 A1 5/1998
EP 3626110 A1 * 3/2020 ..... A45D 20/12

(Continued)

OTHER PUBLICATIONS

"Electromagnetic Waves & Fine Dust Free," Soonsoo Baram, www.soonsooi.com, Date Unknown, 1 page.

(Continued)

*Primary Examiner* — Stephen M Gravini
(74) *Attorney, Agent, or Firm* — Birch, Stewart, Kolasch & Birch, LLP

(57) ABSTRACT

A dryer includes a hollow casing accommodating a fan and a heater and having an open front and an open rear, and a display device disposed at the rear of the casing and covering at least a part of the open rear. The display device and a rear edge of the casing are spaced apart from each other to thereby form an air introduction area that is opened between the display device and a rear edge of the casing. The display device can display a graphic object on at least one of a plurality of display areas. A controller can select a drying object and change the graphic object to a suggested drying temperature based on pre-stored information of the drying object. The controller can also rotate the graphic object on the screen of the display panel based on a rotation posture of the dryer.

20 Claims, 8 Drawing Sheets

(58) Field of Classification Search
USPC ..... 34/95–100
See application file for complete search history.

(56) References Cited

U.S. PATENT DOCUMENTS

| | | | | |
|---|---|---|---|---|
| 6,397,003 | B1 | 5/2002 | Cheng | |
| 6,792,692 | B1 * | 9/2004 | Takizawa | A45D 20/12 34/283 |
| 7,093,376 | B2 * | 8/2006 | Regen | A45D 20/12 132/200 |
| 8,146,264 | B1 | 4/2012 | Stefano et al. | |
| 9,498,039 | B2 * | 11/2016 | Matsui | H01T 23/00 |
| 9,839,274 | B1 * | 12/2017 | Brickner | H04B 1/3833 |
| 9,930,950 | B1 * | 4/2018 | Cage | A45D 20/12 |
| 10,021,952 | B2 * | 7/2018 | Goldman | A45D 44/005 |
| 10,299,560 | B1 * | 5/2019 | Nelson | H01M 2/1022 |
| 10,342,311 | B2 * | 7/2019 | Yue | A45D 20/12 |
| 10,687,597 | B2 * | 6/2020 | Goldman | H01M 10/613 |
| 2005/0204576 | A1 * | 9/2005 | Cohen | A45D 20/12 34/96 |
| 2006/0032077 | A1 * | 2/2006 | Cafaro | A45D 20/10 34/96 |
| 2008/0276479 | A1 * | 11/2008 | Byun | A45D 20/08 34/97 |
| 2012/0000085 | A1 * | 1/2012 | Wright | A45D 20/10 34/97 |
| 2017/0055667 | A1 * | 3/2017 | Chen | A45D 20/12 |
| 2018/0249803 | A1 * | 9/2018 | Matsui | A45D 20/12 |
| 2020/0085162 | A1 * | 3/2020 | Yoo | A45D 20/12 |
| 2020/0085256 | A1 * | 3/2020 | Yoo | A45D 20/10 |
| 2020/0085259 | A1 * | 3/2020 | Yoo | A45D 20/12 |
| 2020/0085261 | A1 * | 3/2020 | Yoo | A47K 10/48 |
| 2020/0085262 | A1 * | 3/2020 | Youn | A45D 20/12 |
| 2020/0093254 | A1 * | 3/2020 | Charraud | A46B 15/0006 |
| 2020/0323326 | A1 * | 10/2020 | Matsui | H05B 1/0252 |
| 2020/0326125 | A1 * | 10/2020 | Sanfilippo | F26B 5/02 |

FOREIGN PATENT DOCUMENTS

| | | | | |
|---|---|---|---|---|
| GB | 2500802 | A | 10/2013 | |
| JP | 3140884 | U * | 4/2008 | A45D 20/08 |
| KR | 10-2009-0117070 | A | 11/2009 | |
| KR | 10-1625834 | | 5/2016 | |
| WO | WO-2006001560 | A1 * | 1/2006 | A45D 20/08 |
| WO | WO-2019094064 | A1 * | 5/2019 | H01M 10/0525 |

OTHER PUBLICATIONS

European Search Report for European Patent appl. No. 20214493.7 dated Apr. 1, 2021.

* cited by examiner

DRYER

CROSS REFERENCE TO RELATED APPLICATIONS

This application claims the priority benefit of U.S. Provisional Application No. 62/733,478, filed on Sep. 19, 2018, Korean Patent Application No. 10-2018-0162188, filed on Dec. 14, 2018, Korean Patent Application No. 10-2019-0022026, filed on Feb. 25, 2019, and Korean Patent Application No. 10-2019-0088428, filed on Jul. 22, 2019, the entire disclosures of all of which are hereby expressly incorporated by reference into the present application.

BACKGROUND OF THE DISCLOSURE

Field of the Disclosure

The present disclosure relates to a dryer including a display device, and more particularly, to a dryer including a display device which is disposed at a rear of the dryer and configured to display an operating status of the dryer.

Description of the Related Art

A dryer for drying a human body should be designed to prevent the human body from being burned or hurt by drying air, and a temperature of the drying air should be maintained at a level at which a user can feel comfortable.

In addition, if a drying target is an infant or a pet, the target may have difficulties in communicating with a user of the dryer, has a very sensitive and weak skin, and has a desirable dry state that is different from that of an adult.

Thus, it is necessary to optimize a drying condition according to a drying target.

The website www.soonsooi.com discloses a dryer having a display unit disposed at a rear portion of the dryer.

The dryer disclosed in www.soonsooi.com does not include a heat dissipating structure, and thus has a problem that properties of the display unit can be degraded due to heat generation of the display unit and heating by a heater during a drying operation.

In addition, the dryer is designed to target adult scalp, and thus has difficulties in performing a drying operation optimized for skin and hair of a baby or a pet.

Further, since a screen displayed on the display unit of the dryer is fixed, a grip should be placed upright to see the numbers during a drying operation.

SUMMARY OF THE DISCLOSURE

The following are technical objects of the present disclosure.

First, the present disclosure provides a dryer which permits a display device to dissipate heat smoothly so that deterioration of the display device can be reduced.

Second, the present disclosure provides a dryer which can be easily controlled by a user with a drying temperature optimized for a drying target.

Third, the present disclosure provides a dryer which allows a graphic object shown on a screen of the display device to be recognized and controlled easily.

Other technical objects of the present disclosure not mentioned herein will be clearly understood from the following description by those skilled in the art to which the inventive concept pertains.

In order to achieve the above objects, the present disclosure provides a dryer having a display device at an open rear of the dryer. The display device may display a suggested drying temperature according to a drying target/drying object.

Specifically, the dryer includes a hollow casing having an open front and an open rear.

The display device is disposed at the rear of the casing and covers at least a part of the open rear.

The display device and a rear edge of the casing may be spaced apart from each other to thereby form an air introduction area that is opened between the display device and a rear edge of the casing.

The dryer may further include a rear cover connected to the rear edge of the casing to cover the rear of the casing.

The display device may be disposed on an outer surface of the rear cover.

The rear cover may include a cylindrical rear cover side wall, of which a front and a rear are open, and a rear cover plate covering the front of the rear cover side wall.

An edge of a rear surface of the rear cover side wall may be connected to a rear edge of the casing.

The rear cover plate may be formed convexly toward the front of the casing.

The rear cover may include a plurality of through holes to introduce air. The plurality of through holes may be disposed at at least one of the rear cover side wall or the rear cover plate.

The display device may be disposed on the rear cover plate and surrounded by the rear cover side wall.

The display device may be disposed between the front and the rear of the front cover side wall.

The rear cover plate has an insertion hole formed at a center thereof, and the display device is inserted into and coupled with the insertion hole.

The display device may include a flared display fixing base in which a cross-sectional area increases from the front toward the rear of the rear cover.

In addition, the display device may include a display panel disposed at one end of the display fixing base, the one end which is adjacent to the rear of the rear cover.

In another general aspect, the present disclosure provides a dryer of which a display device is capable of displaying a suggested drying temperature according to birth information of a drying target.

Specifically, the display device may display a graphic object on at least one of a plurality of display areas.

The display device may include a controller, and the controller may be configured to select a drying object and to change the graphic object based on pre-stored birth information, including at least one of age and a species of the selected drying object, to a suggested drying temperature.

The selecting of the drying object may include changing, by the controller, the graphic object to pre-stored drying objects, and selecting, by a user, one of the changed graphic objects.

Alternatively, the controller may be configured to recognize an identification tag attached to the recognized drying object and then change the graphic object.

The dryer may further include an air temperature sensor configured to sense air temperature information of blowing air.

The controller may be configured to display the graphic object that is changed to an air temperature on at least one of the plurality of display areas based on the air temperature information.

The dryer may further include an external temperature sensor configured to sense body temperature information of a drying object.

The controller may be configured to display the graphic object that is changed to a body temperature on at least one of the plurality of display areas based on the body temperature information.

The dryer may further include a battery.

The controller may be configured to sense charge information of the battery and to display the graphic object that is changed to at least one of a charge rate and a remaining operating time based on the charge information on at least one of the plurality of display areas.

The controller may be configured to sense air speed information and to display the graphic object that is changed to a drying intensity on at least one of the plurality of areas based on the air speed information.

The dryer may further include a gyro sensor configured to sense motion information of the dryer.

The controller may be configured to restrict displaying of the graphic object when the motion information exceeds a reference level, and to display the graphic object when the motion information is equal to or lower than the reference level.

The controller may be configured to enlarge a display area selected by a user from among the plurality of display areas showing the graphic object, while reducing remaining display areas not selected by the user.

In yet another general aspect, the present disclosure provides a dryer including a hollow casing having an open front and an open rear, and a display device disposed at the open rear of the casing to cover at least a part of the open rear.

The display device may include a controller configured to display a graphic object on at least one of a plurality of display areas, and to rotate the graphic object according to a motion of the dryer.

The dryer may further include a gyro sensor configured to sense motion information of the dryer, The display device may include a display panel comprising a screen where the graphic object is displayed.

The controller may be configured to rotate the screen of the display panel based on rotation information regarding the rotating of the graphic object.

An upper point, a lower point, a left point, and a right point meeting an edge of the display panel may be set by virtual lines that vertically and horizontally cross a center of the screen where the graphic object is displayed.

The controller may be configured to rotate the screen of the display panel so that the lower point is positioned closest to a ground surface.

Other unmentioned technical solutions can be clearly understood from the following description by those having ordinary skill in the technical field to which the present disclosure pertains.

DESCRIPTION OF EXEMPLARY EMBODIMENTS

Figure 1:
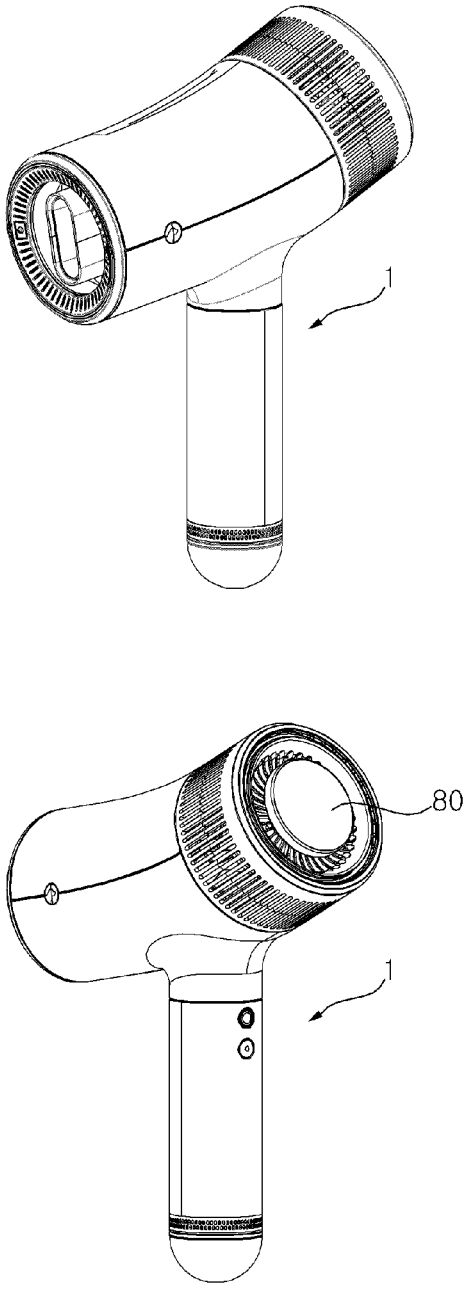
FIG. 1 is a perspective view of a dryer according to an embodiment of the present disclosure.

The advantages and features of the present disclosure and a method of achieving them will become apparent with reference to the embodiments described in detail below together with the accompanying drawings. However, the present disclosure is not limited to the embodiments set forth herein but may be embodied in many different forms, and these embodiments are provided so that the disclosure of the present disclosure is complete and that those skilled in the art will fully understand the scope of the present disclosure, and the present disclosure is only defined by the scope of the claims. Like reference numerals designate like elements throughout the specification.

Hereinafter, a dryer according to an embodiment of the present disclosure will be described with reference to the accompanying drawings.

Figure 2:
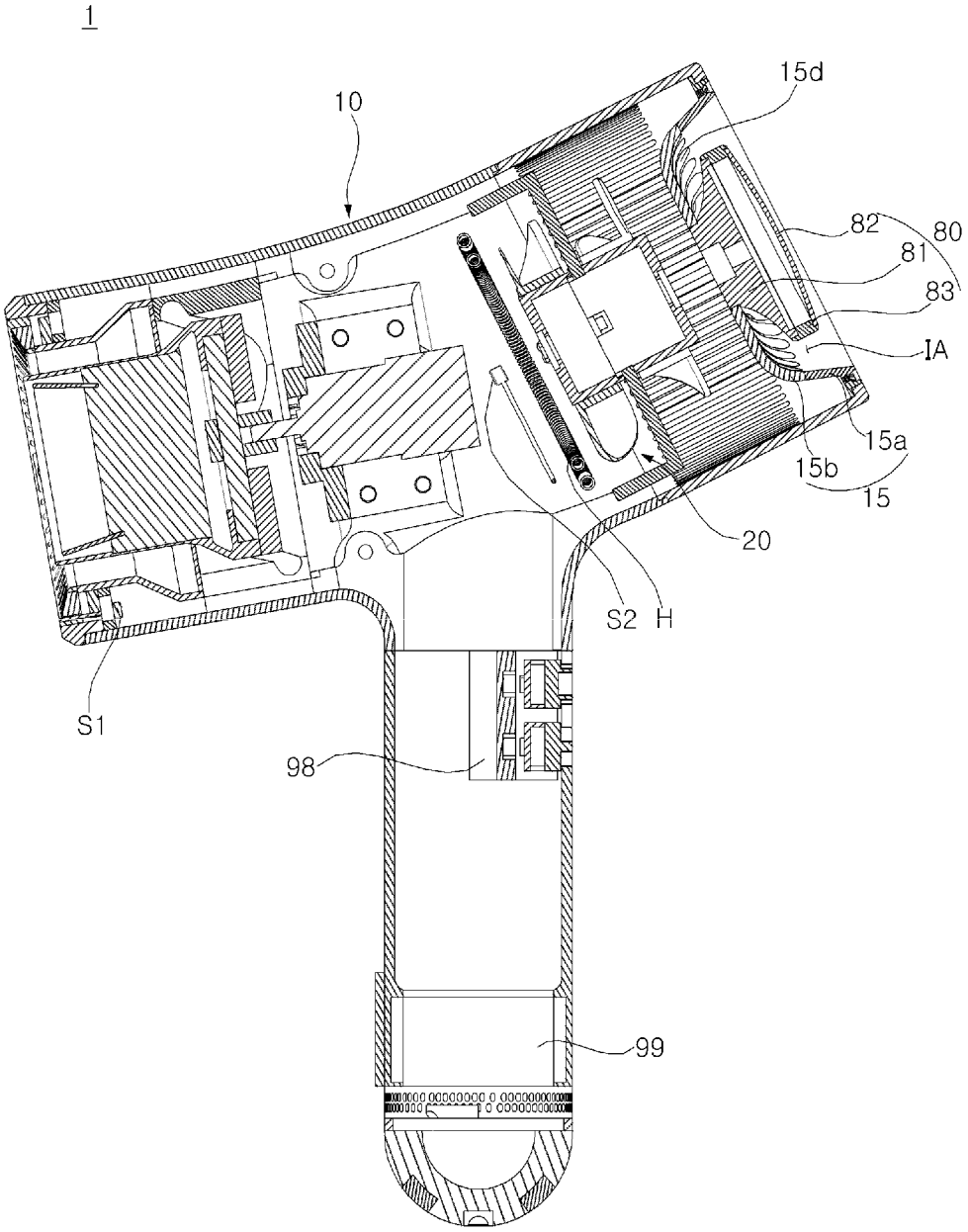
FIG. 2 is a cross-sectional view of the dryer shown in FIG. 1.

A basic configuration and operation of a dryer 1 according to an embodiment of the present disclosure will be described with reference to FIGS. 1 and 2.

The dryer 1 includes a fan 20 to introduce air into the dryer 1 and to blow the air out of the dryer 1, and a heater H to heat the air.

Specifically, the dryer 1 includes a hollow casing 10, the fan 20 accommodated in the casing 10, and the heater H installed downstream of the fan 20 to heat the air.

More specifically, the hollow casing 10 is open at the front and the rear so that air introduced from the rear can be discharged through the front.

The external air may be introduced through the open rear by the fan 20 accommodated in the casing 10.

The fan 20 may be installed inside at a rear side of the casing 10 and may introducing external air through the open rear of the casing 10, and discharge the introduced air through the front of the casing 10.

The air introduced by the fan 20 may be heated by the heater H, and is then discharged through the open front of the casing 10.

The heater H installed downstream of the fan 20 may be formed as a ring-shaped coil heater.

An air temperature sensor S2 may be installed at a downstream side of the heater H to sense a temperature of the heated air. The air temperature sensor S2 may be provided as a pair of sensors installed on the left and right sides in front of the heater H.

However, the shapes and structure of the fan 20, the heater H, and the air temperature sensor S2 vary and are not limited to the above disclosure and the structure shown in the drawings, and they may include any shape and any structure which can be easily modified by those skilled in the art.

In addition, the dryer according to an embodiment of the present disclosure may include a battery 99 to provide power to the fan 20 and the heater H.

Accordingly, the dryer 1 according to an embodiment of the present disclosure can be used even without external power supplied, and therefore, the use of the dryer 1 is not limited and utility thereof can be maximized.

The dryer 1 may include an external temperature sensor S1 to sense a temperature of a target object to be dried or a target body part to be dried. The dryer 1 may also include a controller 98 to control the operation of the dryer 1.

The dryer 1 according to an embodiment of the present disclosure may include a display device 80 disposed at the rear of the casing 10 to thereby cover at least a part of the open rear of the dryer 1.

The display device 80 may visually display an operating status of the dryer 1 to be recognized by a user.

In the specification, the expression that the display device covers the rear means a structure in which the open rear of the casing 10 and the display device 80 overlap each other when the display device 80 is seen from a vertical direction.

In the dryer 1 according to an embodiment of the present disclosure, the display device 80 is disposed rearward of the open rear of the casing 10, through which air is suctioned, so that deterioration of the display device 80 can be reduced.

Figure 3:
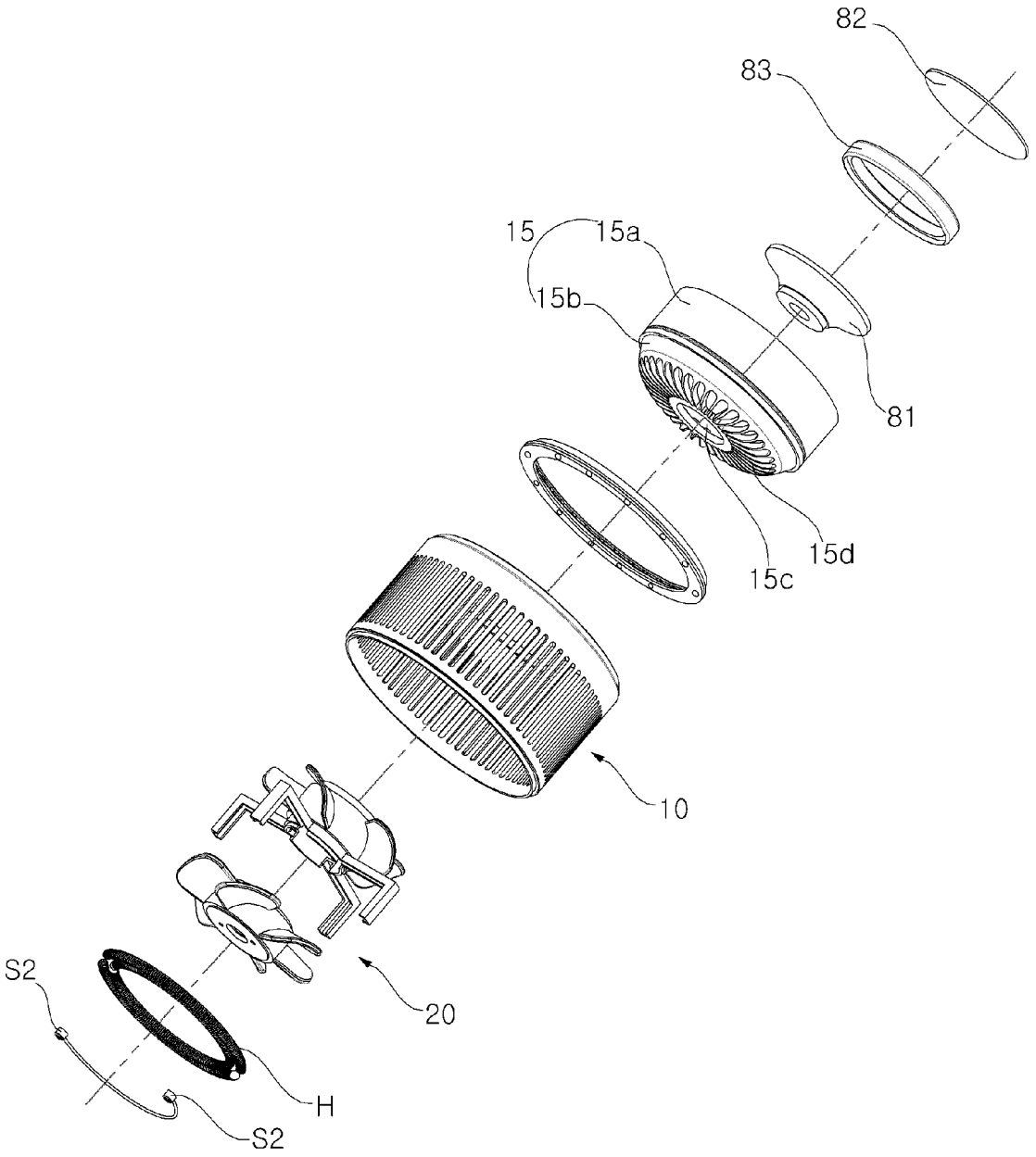
FIG. 3 is an exploded perspective view of a portion of the dryer shown in FIG. 2.
Figure 4:
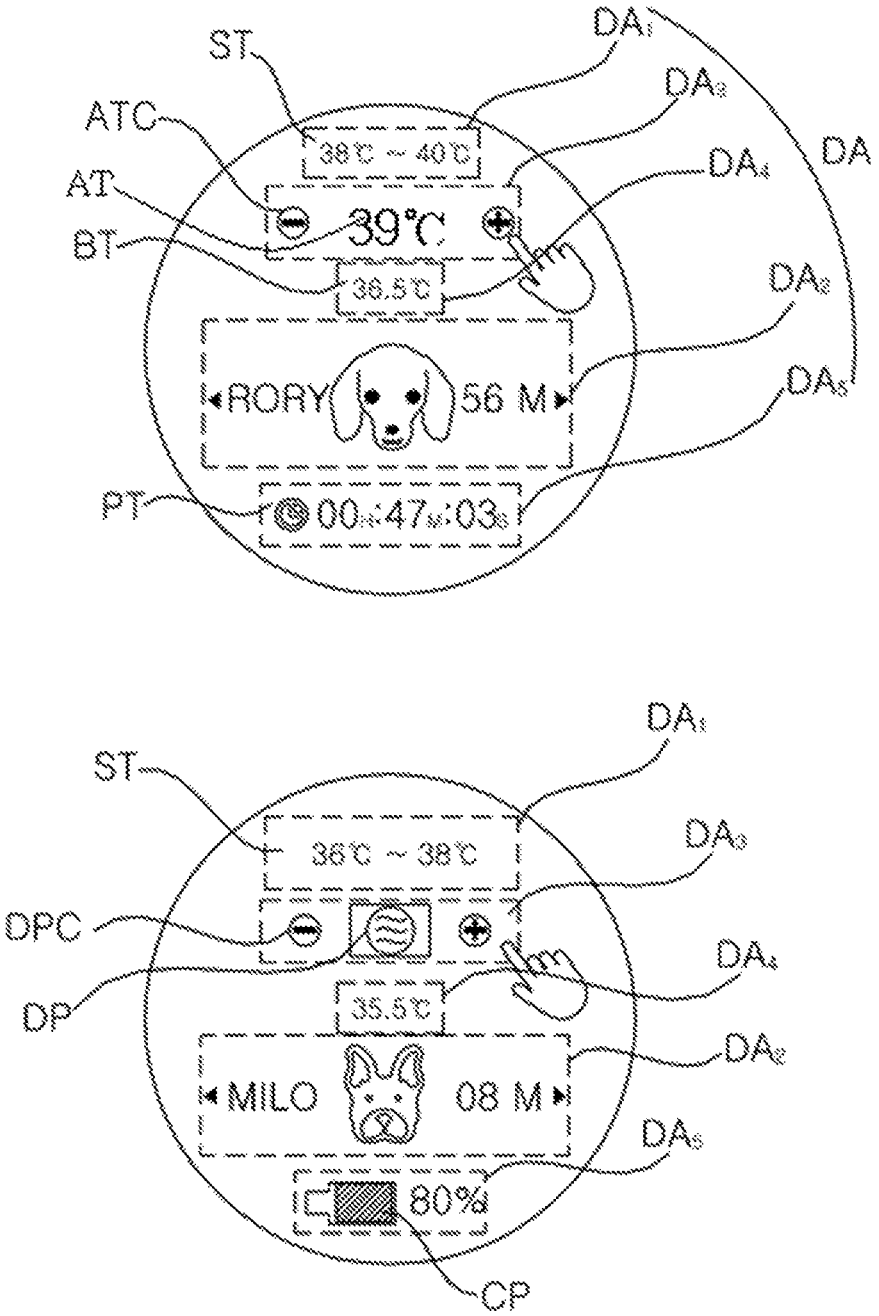
FIG. 4 shows operation of a dryer, which is displayed on a display device included in an embodiment of the present disclosure.

Regarding the above, a structure to couple the casing 10 and the display device 80 will be described with reference to FIGS. 2 and 3.

The dryer 1 according to an embodiment of the present disclosure may include a rear cover 15 that is connected to a rear edge of the casing 10 to thereby cover the rear of the casing 10.

The rear cover 15 may include a generally cylindrical rear cover side wall 15*a* which is open at the front and the rear, and a rear cover plate 15*b* to partially cover the front of the rear cover side wall 15*a*.

The rear cover side wall 15*a* may be accommodated in the casing 10 and disposed with the front opening facing the front of the casing 10 and the rear opening facing the rear of the casing 10.

The edge of the rear of the rear cover side wall 15*a* may be connected to the rear edge of the casing 10 and thus coupled thereto.

The meaning of "coupling" mentioned above or below may refer to a case where two elements are integrally formed or assembled by a well-known coupling technique such as fusion, adhesion, forcible insertion, screw fastening, bolt fastening, and key engagement.

The front of the rear cover side wall 15*a* may be shielded by the rear cover plate 15*b*.

Specifically, an edge of the front of the rear cover side wall 15*a* and a periphery of the rear cover plate 15*b* may be connected and thereby coupled together. In addition, the rear cover plate 15*b* may be a flat plate or may be a curved plate.

For example, the rear cover plate 15*b* may be a curved plate that protrudes convexly toward the front of the casing 10.

In the specification, a description that the front of the rear cover side wall 15*a* is shielded by the rear cover plate 15*b* should be understood to mean that the rear cover plate 15*b* is disposed at the front of the rear cover side wall 15*a* so that at least a part of the front of the rear cover side wall 15*a* is shielded.

An insertion hole 15*c* may be formed in the rear cover plate 15*b*, and the display device 80 may be inserted into and coupled with the insertion hole 15*c*.

For example, the insertion hole 15*c* may be formed at the center of the rear cover plate 15*b*.

The display device 80 may include a display fixing base 81 connecting the display device 80 and the rear cover plate 15*b*, and a display panel 82 visually displaying an operating status of the dryer 1.

Specifically, the display fixing base 81 may be a flared type, of which a cross-sectional area increases from the front to the rear of the rear cover 15, and the display fixing base 81 may form a bottom appearance of the display device 80 and provide an area where a display panel 82 can be arranged.

The display panel 82 may be disposed on one end of the display fixing base 81 adjacent to the rear of the rear cover side wall 15*a*, and visually display an operating status of the dryer 1 to a user.

In addition, the display panel 82 according to an embodiment of the present disclosure may include a touch panel so that the user is allowed to directly control operation of the dryer 1 through the display panel 82.

Further, the display device 80 may further include a joint ring 83 that connects the display panel 82 and the display fixing base 81 so that the display panel 82 and the display fixing base 81 are joined.

The joint ring 83 may be a ring shape that can make the display panel 82 and the display fixing base 81 joined separately.

For example, the display panel 82 may be seated in and coupled with a step formed at one end of the joint ring 83, and the display fixing base 81 may be seated in and coupled with a step formed at the other end of the joint ring 83.

Further, the joint ring 83 may also be used for decoration.

However, functions, shapes, and structures of the display fixing base 81, the display panel 82, and the joint ring 83 are not limited to the above disclosure and the drawings and may include a range that can be easily modified by those skilled in the art.

An end of the display fixing base 81 being adjacent to the front of the rear cover side wall 15*a* may be inserted into the insertion hole 15*c* formed at the center of the rear cover plate 15*b*, so that the display device 80 is coupled on an outer surface of the rear cover 15.

In the dryer 1 according to an embodiment of the present disclosure, an introduction area IA may be formed between the display device 80 and the rear edge of the casing 10, and therefore, air may be introduced into the casing 10 through a plurality of air introduction through holes 15*d* formed in the rear cover 15.

Specifically, the introduction area IA may be an opened area and may be formed between the display device 80 and the rear edge of the casing 10 since the display device 80 and the rear edge of the casing 10 are spaced apart from each other.

When the fan 20 accommodated in the casing 10 is rotated, negative pressure is formed inside the casing 10, and thereby air is introduced into the casing 10 through the introduction area IA.

The air introduced into the casing 10 may move further inside the casing 10 through a plurality of air introduction through holes 15*d* formed in the rear cover 15.

The plurality of through holes 15*d* may be disposed in at least one of the rear cover side wall 15*a* and the rear cover plate 15*b* and may be, for example, formed to surround the insertion hole 15*c*. However, the shape of the through holes 15*d* is not limited to the above disclosure and the drawings.

In the dryer 1 according to an embodiment of the present disclosure, the display device 80 is disposed in an area where air is introduced, thereby decreasing deterioration of the display device 80.

Although heat is generated in operation or heat is generated by the heater H, the display device 80 may effectively dissipate heat and be cooled, and therefore, pixel damage caused by deterioration may be reduced.

Specifically, although heat is generated in the display panel 82, external air can be rapidly introduced into the casing 10 through the introduction area IA, and therefore, the heat generated in the display panel 82 may be dissipated into the casing 10.

In addition, even if the heat generated in the display panel 82 fails to be dissipated into the casing 10, or even if the display device 80 is heated by the heater or the like, external room temperature air may be introduced into the casing 10 and thereby cool the display device 80, and therefore, heat of the display device 80 may be prevented from excessively increasing.

In addition, in the dryer 1 according to an embodiment of the present disclosure, the display device 80 may be disposed inside the rear side of the casing 10, and therefore, durability of the display device 80 may be enhanced.

Specifically, the display device 80 may be disposed on the rear cover plate 15*b* and surrounded by the rear cover side wall 15*a*, and therefore, an external impact delivered to the display device 80 may be minimized.

More specifically, the display device 80 may be disposed between the front and the rear of the rear cover side wall 15*a*, and therefore, there is no portion of the display device 80 protruding outward of the casing 10.

Accordingly, even when the dryer 1 falls down in a rearward direction, most of the impact is not delivered directly to the display device 80 and instead it may be absorbed by the rear edge of the casing 10 or the rear cover side wall 15*a*.

In addition, when the dryer 1 is seen from a side, the display device 80 does not have a portion protruding from the casing 10, which helps to achieve a tidy appearance, and therefore, there is an advantageous effect in terms of design.

Further, in the dryer 1 according to an embodiment of the present disclosure, the rear cover plate 15*b* where the display device 80 is inserted and coupled is formed convexly toward the front of the casing 10, and therefore, coupling stability may be improved.

Specifically, the rear cover plate 15*b* may be convex toward the front and may be in a dome shape.

The rear cover plate 15*b* may improve durability due to the dome shape. Stress may be repeatedly applied by a user's touch input that is input to the display device 80 coupled with the center of to the rear cover plate 15*b*.

However, as the rear cover plate 15*b* is formed in the dome shape that is formed convexly toward the front, it is possible to prevent stress from being gathered at the center of the rear cover plate 15*b* coupled with the display device 80 and to distribute the stress to the entire rear cover plate 15*b* to thereby improving durability.

Next, contents to be visually displayed on the display device 80 according to an embodiment of the present disclosure will be described with reference to FIG. 4 to FIG. 8.

The display panel 82 of the display device 80 includes a plurality of display areas DA on a screen, and displays a graphic object on at least one of the plurality of display areas DA.

For example, a suggested temperature ST according to a drying object DO may be displayed as the graphic object to be displayed visually.

The display areas DA ($DA_1$ to $DA_5$) included in the display device 80 are areas in which a substantially changed graphic object is presented. However, the display areas $DA_1$ to $DA_5$ are not limited to the specific locations in the display device 80 shown in the drawings.

The graphic object is an object that is displayed in a display area DA and thus visually recognizable by a user.

In order to visually provide information on various operating statuses to the user at the same time, the dryer 1 according to the present disclosure may provide the graphic object on the plurality of display areas DA at the same time.

The suggested drying temperature ST may be calculated through selection of the drying object DO and data processing accordingly.

Specifically, a controller 98 selects the drying object DO (S10), derives the suggested temperature ST according to the age and species of the drying object DO based on pre-stored birth information of the selected drying object DO (S20), and changes the graphic object to the suggested drying temperature ST (S30).

The dryer 1 according to an embodiment of the present disclosure may select the drying object DO (S10).

Figure 5:
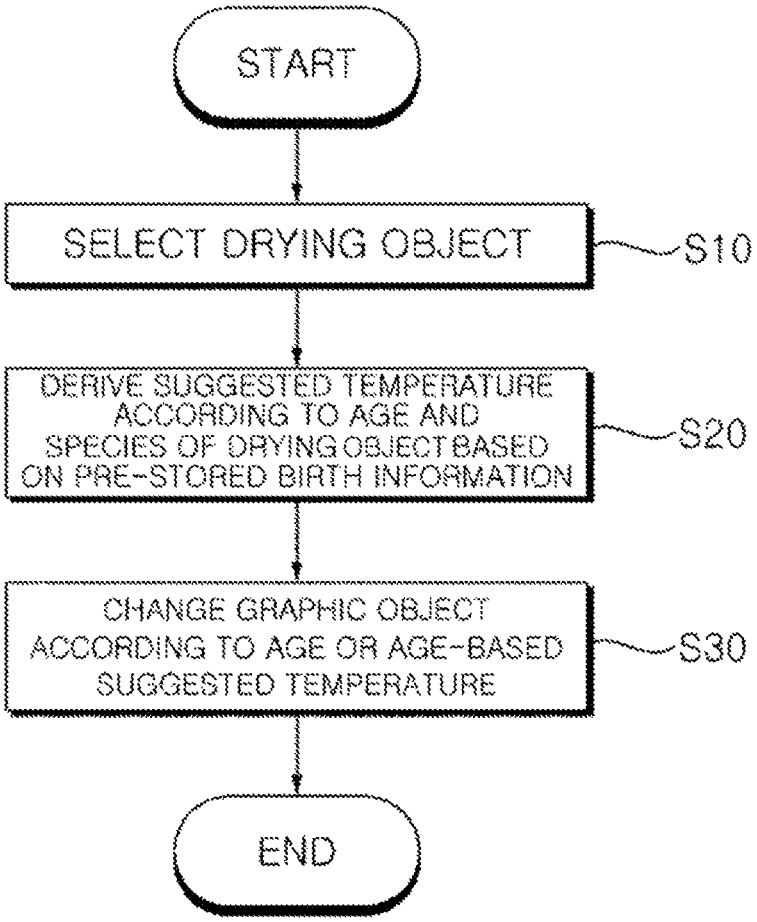
FIG. 5 is a flow chart of a controller according to an embodiment of the present disclosure.
Figure 6:
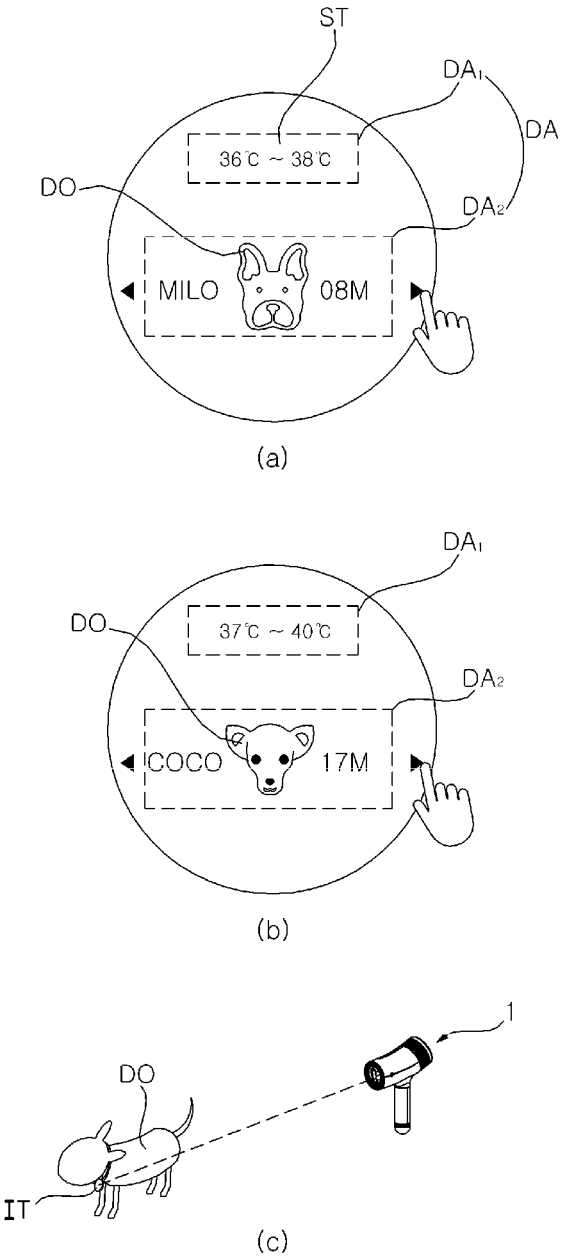
FIG. 6 is a diagram showing a method for selecting a drying object according to an embodiment of the present disclosure.

Referring to FIGS. 5 and 6, the controller 98 may change the graphic object to represent pre-stored drying objects DO, and a user may select one of the changed graphic objects.

The user may pre-store the drying objects DO in the controller 98 through the Internet, a mobile phone application, or the like which is linked with the controller 98.

Specifically, referring to (a) and (b) of FIG. 6, the controller 98 may change graphic objects to pre-stored drying objects DO and display the drying objects DO on the display device 80 sequentially or simultaneously.

The user may select a drying object DO from among the graphic objects changed in correspondence to the drying objects, thereby confirming the drying object DO.

The user may select some of the graphic objects displayed on the display device 80 by directly touching the display device 80 or by using a selection member (pen) or the like.

In addition, referring to FIG. 6, the dryer 1 may automatically recognize and select the drying object DO without the user's selection of the drying object DO.

Specifically, one drying object DO may have an identification tag IT that differentiates the drying object DO from other drying objects.

The controller 98 of the dryer 1 makes a selection by recognizing a unique identification tag IT, and thus, the controller 98 may change a graphic object to a drying object DO corresponding to the recognized identification tag IT and display an image of the drying object DO on the display device 80.

The identification tag IT may be formed as an accessory such as a necklace or an anklet, but a type of the identification tag IT is not limited to the above disclosure or the drawings and may include a range that can be easily modified by those skilled in the art.

The controller 98 may be wirelessly connected to the identification tag IT and thereby recognize the identification tag IT.

Specifically, each of the controller 98 and the identification tag IT may include a wireless communication unit and thereby exchange data with each other. For example, if the wireless communication unit includes a Near Field Communication (NFC) module and tagging is performed within a predetermined distance, the controller 98 and the identification tag IT may communicate each other wirelessly.

However, the method for recognizing the identification tag IT by the controller 98 and the configuration of the controller 98 are not limited to the above disclosure and may include a range that can be easily modified by those skilled in the art.

Referring again to FIGS. 4 and 5, when a drying object DO is displayed on the display device 80, the controller 98 may display the drying object DO and a suggested drying temperature ST for the drying object DO together.

The controller 98 may derive the suggested drying temperature ST based on pre-stored birth information including at least one of age and a species of the drying object DO (S20), and change a graphic object with the suggested drying temperature ST (S30).

In addition, the controller 98 may also change the graphic object to the age of the drying object DO based on the birth information.

The birth information may include at least one of a species (dog, cat, human, snake, mouse, etc.) of the drying object DO, and a classification and a birth date of the species (e.g., Siberian Husky, Maltese, Shiba, etc. when the drying object DO is a dog).

The controller 98 may calculate the age of the drying object DO based on the birth information, and display a suggested drying temperature optimized for the drying object DO based on a species and a classification of the species, thereby minimizing stress that can affect the drying object DO during a drying operation.

For example, when the drying object DO is a dog, a puppy has sensitive skin and short hair compared to a grown-up dog, and thus a drying operation needs to be performed at a relatively low temperature.

In addition, dogs may be classified into long-haired dogs and short-haired dogs according to hair length, or dogs may have a thin or thick fat layer under their skin. Thus, an optimized suggested drying temperature ST may vary according to each drying object DO.

The dryer 1 according to an embodiment of the present disclosure may include an air temperature sensor to sense temperature information of blowing air.

The controller 98 may change the graphic object to show air temperature AT and an air temperature control ATC based on the air temperature information.

The suggested drying temperature ST displayed upon selection of the drying object DO and the air temperature AT of blowing air are displayed together on the display device 80.

Thus, as a user may manipulate the air temperature control ATC using a touch so that the air temperature AT is maintained within a range of the suggested temperature ST, a drying operation may be performed at a temperature optimized for the drying object DO.

The dryer 1 according to an embodiment of the present disclosure may include an external temperature sensor S1 to sense body temperature information of the drying object DO.

For example, the external temperature sensor S1 may be disposed at a front outlet of the dryer 1 to sense body temperature information of the drying object DO using an infrared device.

The controller 98 changes the graphic object to a body temperature BT based on body temperature information of the drying object DO.

Further, the controller 98 may change the graphic object to the body temperature BT, the air temperature AT, and the suggested drying temperature ST at the same time, and therefore, a drying operation may be performed effectively.

That is, the controller 98 may display a current body temperature BT, the suggested drying temperature ST, and the air temperature AT together on the display device 80.

Thus, as the current body temperature BT and the suggested drying temperature ST are taken into consideration, a drying operation may be performed optimally without causing stress to the drying object DO due to a drastic change in temperature.

The dryer 1 according to an embodiment of the present disclosure includes a battery 99.

The controller 98 senses charge information of the battery 99 and changes the graphic object to at least one of a charge rate CP and a remaining operating time PT based on the charge information.

Thus, the user may predict a time available for drying, and thus, it is possible to prevent a drying operation from being stopped suddenly.

In the dryer 1 according to an embodiment of the present disclosure, the controller 98 may sense air speed information of the fan 20, and change the graphic object to drying intensity DP and a drying intensity control (DPC).

Thus, the user may increase or decrease an air speed according to a drying situation.

The dryer 1 according to an embodiment of the present disclosure may further include a gyro sensor that senses motion information of the dryer 1. The gyro sensor may be included within the controller 98.

For example, the gyro sensor may sense motion information on a degree of rotation of the dryer 1 in three-dimensions (3D) and a speed of rotation of the dryer 1.

When it is determined, based on the motion information, that the speed of rotation of the dryer 1 exceeds a pre-stored reference level, the controller 98 may restrict displaying of the display device 80.

Further, when the speed of rotation of the dryer 1 is equal to or lower than the reference level, the controller 98 may maintain displaying of the display device 80.

The controller 98 according to an embodiment of the present disclosure may determine, based on the motion information, whether a drying operation is actually performed, and may restrict displaying of the display device 80 while the drying operation is performed, and therefore, power of the battery 99 may be used effectively.

For example, when the speed of rotation of the dryer 1 is equal to or lower than the reference level, the controller 98 may determine that the dryer 1 is not being rotated but is stopped.

While the dryer 1 is stopped, an operation of the dryer 1 may be controlled by restricting displaying of the display device 80.

However, the restricting of the displaying of the display device 80 based on the motion information is not essential and may be not performed according to a user's setting.

The controller 98 according to an embodiment of the present disclosure may enlarge a display area DA selected by a user from among a plurality of display areas $DA_1$ to $DA_5$ or a display area DA expressing graphic objects, and reduce the remaining display areas DA not selected by the user.

Figure 7:
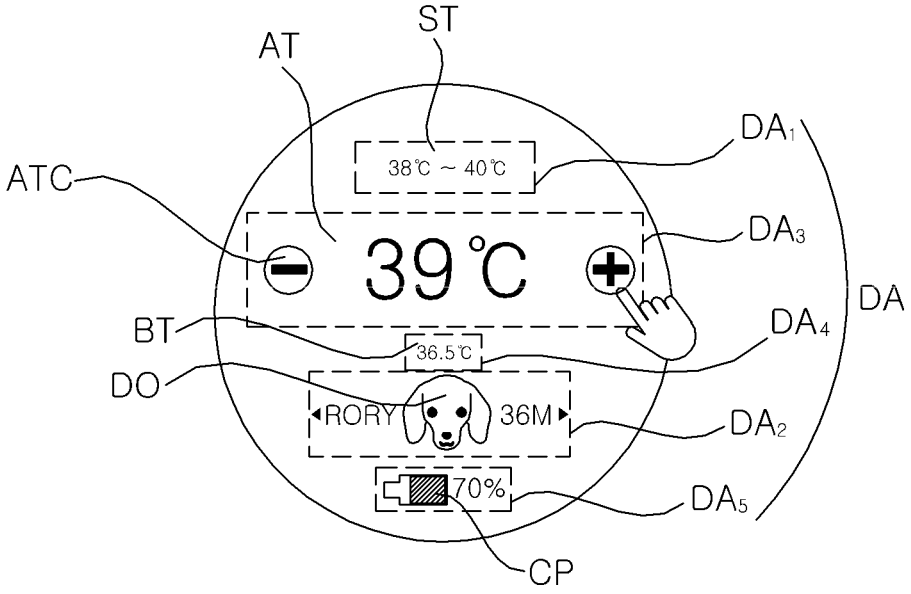
FIG. 7 shows operation of a dryer displayed in a display device according to an embodiment of the present disclosure.

For example, referring to FIG. 7, the user needs to touch or select a portion indicative of increase in the air temperature control ATC in order to increase the drying air temperature AT.

At this point, if a user first selects the display area $DA_3$ showing the air temperature AT and the air temperature control ATC from among the various display areas $DA_1$ to $DA_5$, the controller 98 may enlarge the selected display area $DA_3$ while reducing the unselected display areas $DA_1$, $DA_2$, $DA_4$, and $DA_5$.

Thus, the user may increase the air temperature AT by easily selecting the air temperature control ATC enlarged in the enlarged display area $DA_3$.

The controller 98 according to an embodiment of the present disclosure may rotate the graphic object according to a motion of the dryer 1.

That is, the controller 98 according to an embodiment of the present disclosure rotates the graphic object by reflecting a rotated state and a tilting state of the dryer 1, thereby allowing the user to easily recognize and control the graphic object.

Figure 8:
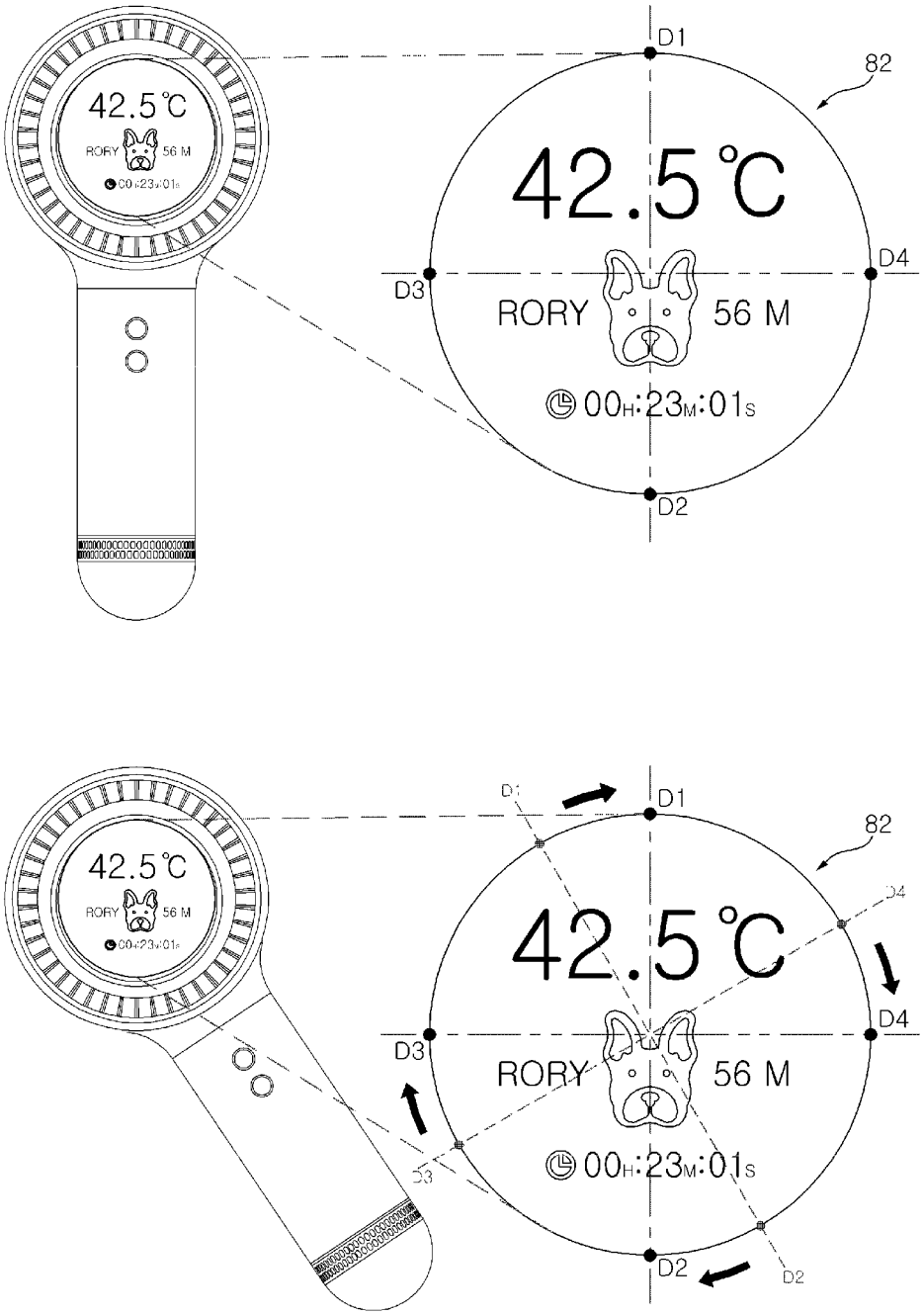
FIG. 8 shows an operation in which a graphic object displayed on a display device according to an embodiment of the present disclosure is rotated according to a motion of a dryer.

Referring to FIG. 8, the dryer 1 according to an embodiment of the present disclosure may display the graphic object in an upright posture on a screen of the display panel 82 with reference to a field of view of the user, regardless of a degree of rotation of the dryer 1 and a degree of tilt of the dryer 1.

In the specification, the meaning of the graphic object displayed in the upright posture is that the graphic object is displayed in an erected posture, not in a tilted posture, within the field of view of the user when the user views the graphic object presented at the rear of the dryer 1 while the dryer 1 is rotated or tilted.

Specifically, the display panel 82 includes a screen where the graphic object is displayed, and the controller 98 may rotate the screen of the display panel 82 based on rotation information sensed by the gyro sensor.

Due to the rotation of the screen of the display panel 82, the graphic object may be displayed in an erected posture in the field of view of the user.

More specifically, the controller 98 may set virtual partition lines that vertically and horizontally cross the center of the screen where the graphic object is displayed.

In addition, the controller 98 may set points at which the partition lines and an edge of a screen of the display panel 82 meet as an upper point D1, a lower point D2, a left point D3, and a right point D4.

The controller 98 may reflect motion information of the gyro sensor to rotate the screen of the display panel 82 so that the lower point D2 at the edge of the display panel 82 is positioned closest to a ground surface.

As the screen of the display panel 82 is rotated, the graphic object displayed on the screen is rotated as well.

Thus, if the user places the rear of the dryer 1 within the field of view of the user in order to view the graphic object displayed on the display device 80, regardless of a direction from which the user grips the dryer 1 or regardless of a degree which the user tilts the dryer 1 during a drying operation, the user may be able to easily recognize and control the graphic object being rotated.

As such, a dryer 1 according to an embodiment of the present disclosure is described with reference to the accompanying drawings. However, the present disclosure is not limited to the above embodiment, and it will be apparent to those skilled in the art that various modifications and changes can be made to the disclosure without departing from the spirit and scope of the disclosure. Therefore, it should be understood that the embodiments are provided by way of illustration only and are given to provide complete disclosure of the disclosure and to provide thorough understanding of the disclosure to those skilled in the art. Thus, it is intended that the disclosure covers the modifications and variations of this disclosure provided they come within the scope of the appended claims and their equivalents.

According to the dryer 1 of the present disclosure, there are one or more effects as below.

First, the dryer 1 according to the present disclosure include the display device 80 disposed at the open rear through which air is introduced, thereby effectively decreasing deterioration of the display device 80.

Specifically, the display device 80 is disposed in the introduction area IT, and therefore, although heat is generated in the display device 80, the heat may be emitted at the same time when air is introduced.

In addition, although the display device 80 is heated by the heater H, the display device 80 is cooled by external air at room temperature introduced into the dryer 1, thereby reducing deterioration of the display device 80.

Second, the controller 98 of the dryer 1 according to the present disclosure visually displays a suggested drying temperature ST optimized for an age and a species of a drying object DO on the display device 80, thereby easily performing an optimized drying operation.

Third, the dryer 1 according to the present disclosure rotates a graphic object displayed on the display device 80 according to a motion of the dryer 1, thereby allowing a user to easily recognize and control the graphic object.

Specifically, a graphic object may be rotated based on rotation or tilt of the dryer 1 to thereby be shown upright within the field of view of the user, thereby allowing the user to easily recognize the graphic object and control the dryer 1.

It will be appreciated by persons skilled in the art that the effects that can be achieved with the present disclosure are not limited to what has been particularly described hereinabove and other effects not mentioned in the present disclosure will be more clearly understood from the following detailed description taken in conjunction with the accompanying drawings.

What is claimed is:

1. A dryer, comprising:

a hollow casing having a front opening and a rear opening:

a fan located within the casing to produce a flow of air;

a heater located within the casing to heat the flow of air;

a rear cover connected to a rear edge of the casing to cover a rear of the casing; and a display located at the rear of the casing and within a portion of the rear opening, wherein the display is spaced apart from a rear edge of the casing to thereby provide an air introduction area between the display and the rear edge of the casing, and wherein the rear cover comprises:

a cylindrical rear cover side wall, of which a front and a rear are open; and a rear cover plate covering the front of the rear cover side wall and being convex toward a front of the casing.

2. The dryer of claim 1, wherein the display is located at an outer side of the rear cover.

3. The dryer of claim 2, wherein a rear side of the rear cover side wall is connected to the rear edge of the casing.

4. The dryer of claim 3, wherein the rear cover plate has a convex front surface and a concave rear surface.

5. The dryer of claim 3, wherein the rear cover further comprises a plurality of through holes to permit air to be introduced into the casing, and wherein the through holes are disposed in at least one of the rear cover side wall or the rear cover plate.

6. The dryer of claim 3, wherein the display is disposed on the rear cover plate and surrounded by the rear cover side wall.

7. The dryer of claim 3, wherein the rear cover plate includes an insertion hole located at a center of the rear cover plate, and wherein a portion of the display is located within the insertion hole and coupled to the rear cover plate at the insertion hole.

8. The dryer of claim 5, wherein the display comprises:

a display fixing base, the display fixing base having a cross-sectional area that increases from a front of the display fixing base toward a rear of the display fixing base; and a display panel located at the rear of the display fixing base.

9. The dryer of claim 1, wherein a rearmost portion of the display is located forwardly of a rearmost portion of the rear edge of the casing, to thereby protect the display from external impacts.

10. A dryer, comprising:

a hollow casing having a front opening and a rear opening;

a rear cover connected to a rear edge of the casing to cover a rear of the casing, the rear cover including:

a cylindrical rear cover side wall, of which a front and a rear are open; and a rear cover plate covering the front of the rear cover side wall and being convex toward a front of the casing;

a display located at the rear of the casing and within a portion of the rear opening spaced apart from the rear edge of the casing to thereby provide an air introduction area between the display and the rear edge of the casing and having a plurality of display areas, the display being configured to display a graphic image on at least one of the display areas; and a controller configured to:

control the display to display the graphic image on the display as a drying object;

select the drying object;

derive a suggested drying temperature for the selected drying object from pre-stored information including at least one of an age of the selected drying object and a species of the selected drying object; and control the display to change the graphic image on the display to display the suggested drying temperature of the selected drying object.

11. The dryer of claim 10, wherein the controller is further configured to select the drying object by:

controlling the display to display graphic images of pre-stored drying objects; and selecting, by a user, one of the graphic images.

12. The dryer of claim 10, wherein the controller is further configured to select the drying object by:

recognizing an identification tag attached to the drying object; and selecting, by the controller, the drying object associated with the recognized identification tag.

13. The dryer of claim 10, further comprising an air temperature sensor to sense air temperature information of air flowing in the dryer, wherein the controller is further configured to control the display to change the graphic image on at least one of the display areas to display an air temperature based on the air temperature information.

14. The dryer of claim 10, further comprising an external temperature sensor to sense body temperature information of the drying object, wherein the controller is further configured to control the display to change the graphic image on at least one of the display areas to display a body temperature based on the body temperature information.

15. The dryer of claim 10, further comprising a battery, wherein the controller is further configured to:

sense charge information of the battery; and control the display to change the graphic image on at least one of the display areas to display at least one of a charge rate and a remaining operating time based on the charge information.

16. The dryer of claim 10, wherein the controller is further configured to:

sense air speed information of air flowing in the dryer; and control the display to change the graphic image on at least one of the display areas to display a drying intensity based on the air speed information.

17. The dryer of claim 10, wherein the controller is further configured to:

sense motion information of the dryer;

control the display to restrict displaying of the graphic image when the motion information exceeds a reference level; and control the display to display the graphic image when the motion information is equal to or lower than the reference level.

18. The dryer of claim 10, wherein the controller is further configured to control the display to enlarge a size of a display area selected by a user from among the plurality of display areas showing the graphic image, while reducing sizes of remaining display areas not selected.

19. A dryer, comprising:

a hollow casing having a front opening and a rear opening;

a fan located within the casing to produce a flow of air;

a heater located within the casing to heat the flow of air;

a display located at a rear of the casing and within a portion of the rear opening; and a controller configured to:

control the display to display a graphic image on the display;

sense motion information of the dryer; and control the display to rotate the graphic image on the display according to the motion information of the dryer.

20. The dryer of claim 19, wherein the controller is further configured to control the display based on the rotation information of the dryer to rotate the graphic image on the display to match a rotation of the dryer so that a lowest portion of the graphic image maintains an orientation closest to a ground surface below the dryer.

* * * * *